US007202834B2

(12) United States Patent
Nagano et al.

(10) Patent No.: US 7,202,834 B2
(45) Date of Patent: Apr. 10, 2007

(54) FEEDHORN, RADIO WAVE RECEIVING CONVERTER AND ANTENNA

(75) Inventors: Atsushi Nagano, Osaka (JP); Yosuke Okabe, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/311,399

(22) Filed: Dec. 20, 2005

(65) Prior Publication Data

US 2006/0097943 A1 May 11, 2006

Related U.S. Application Data

(62) Division of application No. 10/901,056, filed on Jul. 29, 2004, now Pat. No. 7,109,941.

(30) Foreign Application Priority Data

Aug. 11, 2003 (JP) ..... 2003-291714

(51) Int. Cl.
*H01Q 13/00* (2006.01)

(52) U.S. Cl. ..... 343/786; 343/772; 343/785

(58) Field of Classification Search ..... 343/786, 343/771, 772, 785
See application file for complete search history.

(56) References Cited

U.S. PATENT DOCUMENTS 6,501,432 B2 * 12/2002 Yuanzhu ..... 343/772
2005/0140560 A1 * 6/2005 Nagano et al. ..... 343/786
2006/0125705 A1 * 6/2006 Nagano ..... 343/786

FOREIGN PATENT DOCUMENTS

| | | |
|---|---|---|
| JP | 2272901 | 11/1990 |
| JP | 05-059926 | 8/1993 |
| JP | 10256822 | 9/1998 |
| JP | 2001-217644 | 8/2001 |
| JP | 2002009542 | 1/2002 |
| JP | 2002-353728 | 12/2002 |

* cited by examiner

*Primary Examiner*—Trinh Vo Dinh
(74) *Attorney, Agent, or Firm*—Nixon & Vanderhye P.C.

(57) ABSTRACT

A feedhorn, a radio wave receiving converter, and an antenna that can be reduced in size and have high reliability can be obtained. A feedhorn portion constitutes part of a converter, and includes a chassis body with a waveguide having an opening, a dielectric as a dielectric member connected to the opening, and a waterproof cover as a protective member. The waterproof cover covers the dielectric and contacts (tightly attached) to a portion of the surface of the dielectric (in the dielectric, the portion of the surface away from waveguide). The waterproof cover is formed of a material having substantially the same electric characteristics (permittivity and dielectric loss tangent) as the material forming the dielectric.

6 Claims, 4 Drawing Sheets

FEEDHORN, RADIO WAVE RECEIVING CONVERTER AND ANTENNA

This application is a divisional of U.S. patent application Ser. No. 10/901,056, filed Jul. 29, 2004 now U.S. Pat. No. 7,109,941, which nonprovisional application is based on Japanese Patent Application No. 2003-291714 filed with the Japan Patent Office on Aug. 11, 2003, the entire contents of which are hereby incorporated by reference.

BACKGROUND OF THE INVENTION

1. Field of the Invention

The present invention relates to a feedhorn, a radio wave receiving converter and an antenna, and particularly, to a feedhorn including a dielectric, a radio wave receiving converter and an antenna.

2. Description of the Background Art

Conventionally, an antenna for receiving a radio wave of satellite broadcasting or the like is known. To the antenna, a radio wave receiving converter is arranged. As a member constituting the radio wave receiving converter, a feedhorn in which a dielectric is connected to an open end of a waveguide is known (for example, see Japanese Patent Laying-Open No. 2001-217644).

According to Japanese Patent Laying-Open No. 2001-217644, a portion of a dielectric is press-fitted with the internal circumference of the open end of a waveguide, whereby the dielectric is fixedly connected to the waveguide.

With the feedhorn of such a structure, however, high dimensional precision of the internal circumference of the waveguide and the portion of the dielectric must be retained, otherwise the reliability of a connecting portion between the waveguide and the dielectric cannot be maintained. Additionally, the strength of the connecting portion between the waveguide and the dielectric may possibly change if the dielectric expands or shrinks due to heat, affected by changes in the ambient temperature. This will also degrade the reliability of the connecting portion. As a result, the reliability of a converter including the feedhorn, and hence, of an antenna including the converter may be degraded.

Additionally, since an antenna is often installed outdoors, a cover is provided as a protective member covering the dielectric, in order to protect the dielectric of the feedhorn from the external environment. Conventionally, the material forming the cover has been different from that forming the dielectric. Therefore, in order to prevent the cover from providing a negative effect to electric characteristics (such as radiation characteristics) of the dielectric, a space has been provided between the dielectric and the cover. As a result, the cover that is considerably larger than the dielectric has been required. Such a large cover has been hindering the converter including the feedhorn, and hence the antenna including the converter, in reducing their size.

SUMMARY OF THE INVENTION

The present invention is made to solve the problems described above, and an object of the present invention is to provide a feedhorn, a radio wave receiving converter and an antenna that can be reduced in size.

Another object of the present invention is to provide a feedhorn, a radio wave receiving converter and an antenna that have high reliability.

The feedhorn according to the present invention includes: a chassis body including a waveguide having an opening; a dielectric member connected to the opening; and a protective member. The protective member covers the dielectric member and contacts to a portion of a surface of the dielectric member. The protective member is made of a material having substantially same permittivity and dielectric loss tangent as a material forming the dielectric member.

In such a case, as the protective member and the dielectric member can be regarded as an integral dielectric, the dielectric member can be protected by the protective member, and simultaneously, the feedhorn exhibiting an excellent electric characteristics can be implemented.

Additionally, as the dielectric member and the protective member can be brought into contact with each other, provision of the space between the dielectric member and the protective member is not necessary. Accordingly, the dielectric member and the protective member can be made similar in their size. In other words, the protective member can be reduced in size than conventional technique. Accordingly, the feedhorn can be reduced in size.

In the feedhorn, the material forming the protective member may be a weatherproof material.

In such a case, when the feedhorn is used outdoors, soundness of the protective member can be maintained for a longer period. Accordingly, the possibility of intrusion of water or the like into inside of the feedhorn invited by degradation of the protective member can be reduced. As a result, the reliability of the feedhorn can be improved.

In the feedhorn, the protective member may include an end extending on the surface of the chassis body and to which the nail portion is formed. In the chassis body, on a surface facing to the end of the protective member, a protruding portion mating with the nail portion may be formed. The protective member is fixed to the chassis body by the nail portion and the protruding portion mating with each other, and it may push the dielectric member toward the chassis body side.

In such a case, with a relatively simple structure where the nail portion and the protruding portion mate with each other, the protective member can be fixed to the chassis body. By the protective member pushing the dielectric member, it is ensured that the dielectric member is fixedly connected to the opening of the waveguide of the chassis body. Accordingly, the possibility of the occurrence of defectiveness such as disconnection of the connecting portion of the dielectric member and the opening of the waveguide can be reduced. As a result, the feedhorn with high reliability can be obtained.

The feedhorn may further include an airtightness retaining portion for retaining airtightness of the connecting portion of the chassis body and the protective member.

In such a case, the possibility of intrusion of water or the like into inside (where the dielectric member is located, or inside the waveguide to which the dielectric member is connected) of the feedhorn can be reduced. Accordingly, the possibility of the occurrence of the problem that the electric characteristics of the feedhorn is impaired by the intrusion of water or the like can be reduced.

In the feedhorn, the airtightness retaining portion may include a packing arranged in the groove formed on the surface in the chassis body facing to the end of the protective member. The packing preferably contacts to the inner wall of the groove and contacts to a portion of a surface of the end of the protective member, the portion facing to the groove.

In such a case, with a simple structure using the packing, the airtightness retaining portion retaining airtightness of the connecting portion of the protective member and the chassis body can be implemented. Accordingly, increase in manufacturing costs of the feedhorn can be suppressed, which is associated with formation of the airtightness retaining portion.

A feedhorn according to the present invention includes: a chassis body including a waveguide having an opening; and a dielectric member connected to the opening, and having a surface partially exposed to outside of the feedhorn. The dielectric member includes an end extending on a surface of the chassis body and to which a nail portion is formed. In the chassis body, on a surface facing to the end of the dielectric member, a protruding portion mating with the nail portion may be formed. The dielectric member is fixed to the chassis body by the nail portion mating with the protruding portion.

In such a case, with a relatively simple structure in which the nail portion and the protruding portion mate with each other, the dielectric member can surely be fixed to the chassis body. Accordingly, the possibility of the occurrence of defectiveness such as disconnection of the connecting portion of the dielectric member and the opening of the waveguide can be reduced. As a result, the feedhorn having high reliability can be obtained.

Additionally, as the surface of the dielectric member partially exposed to the outside of the feedhorn, i.e., a protective member for protecting the dielectric member is not provided, the feedhorn can be reduced in size.

In the feedhorn, the material forming the dielectric member may be a weatherproof material.

In such a case, when the feedhorn is used outdoors, soundness of the dielectric member can be maintained for a longer period. Accordingly, the possibility of intrusion of water or the like into inside of the feedhorn invited by degradation of the dielectric member can be reduced. As a result, the reliability of the feedhorn can be improved.

The feedhorn portion may further include an airtightness retaining portion for retaining airtightness of the connecting portion of the chassis body and the dielectric member.

In such a case, the possibility of intrusion of water or the like into inside of the feedhorn (inside the waveguide) can be reduced. Accordingly, the possibility of the occurrence of the problem that the electric characteristics of the feedhorn is impaired by the intrusion of water or the like can be reduced.

In the feedhorn, the airtightness retaining portion may include a packing arranged in the groove formed on the surface in the chassis body facing to the end of the dielectric member. The packing contacts to the inner wall of the groove and contacts to a portion of a surface of the end of the dielectric member, the portion facing to the groove.

In such a case, with a simple structure using the packing, the airtightness retaining portion retaining airtightness of the connecting portion of the dielectric member and the chassis body can be implemented. Accordingly, increase in manufacturing costs of the feedhorn can be suppressed, which is associated with formation of the airtightness retaining portion.

A radio wave receiving converter according to the present invention includes the feedhorn. An antenna according to the present invention includes the radio wave receiving converter.

Thus, the radio wave receiving converter and the antenna of small size and with high reliability can be implemented.

According to the present invention, by forming the dielectric member and the protective member with materials of similar electric characteristics, the dielectric member and the protective member can be tightly attached to each other to be integral. Therefore, the feedhorn or the like can be reduced in size. Additionally, since the protective member and the dielectric member can be brought into contact to each other, the protective member can be used as a fixing member for connecting the dielectric member to the chassis body. Accordingly, the dielectric member and the chassis body can be connected with high reliability. As a result, the feedhorn, the radio wave receiving converter, and the antenna of small size and with high reliability can be implemented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
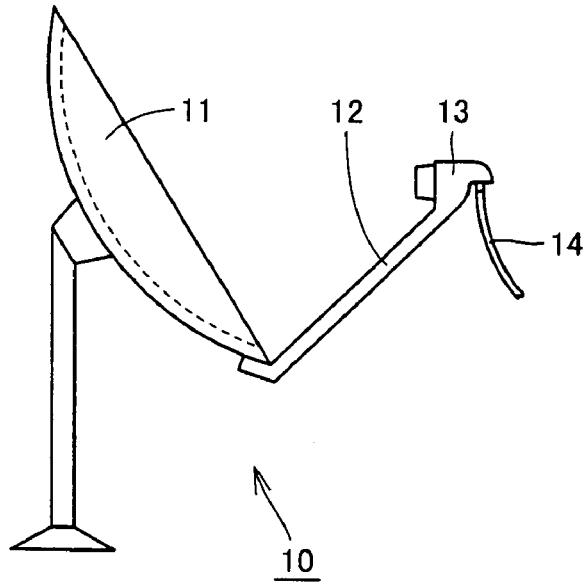
FIG. 1 is a schematic illustration showing a first embodiment of an antenna for receiving satellite broadcasting according to the present invention.

In the following, embodiments of the present invention will be described based on the drawings. Throughout the figures, the same or corresponding parts are given the same reference characters, and the description thereof will not be repeated.

First Embodiment

Figure 2:
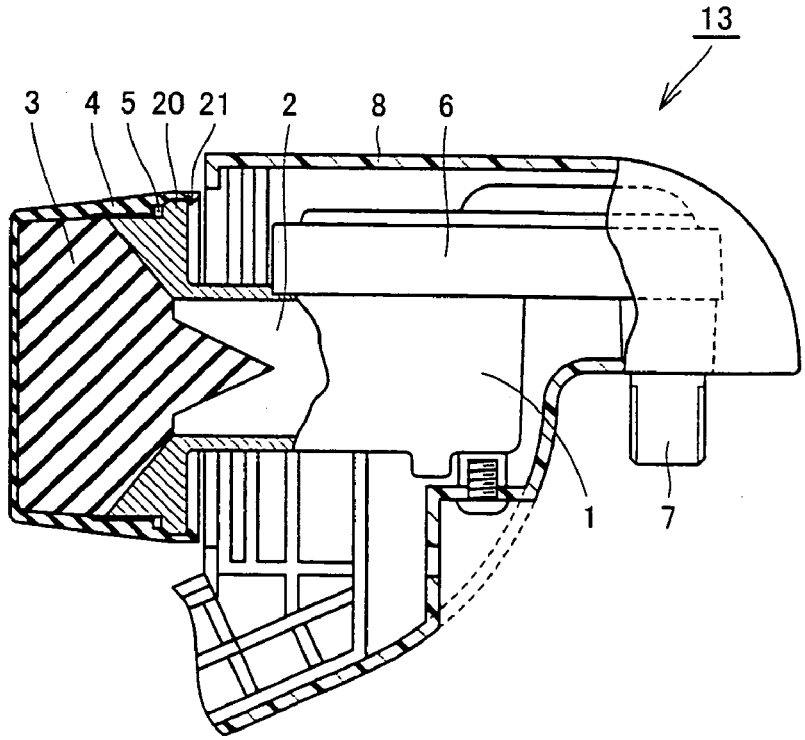
FIG. 2 is a schematic illustration showing a converter used in the antenna shown in FIG. 1.
Figure 3:
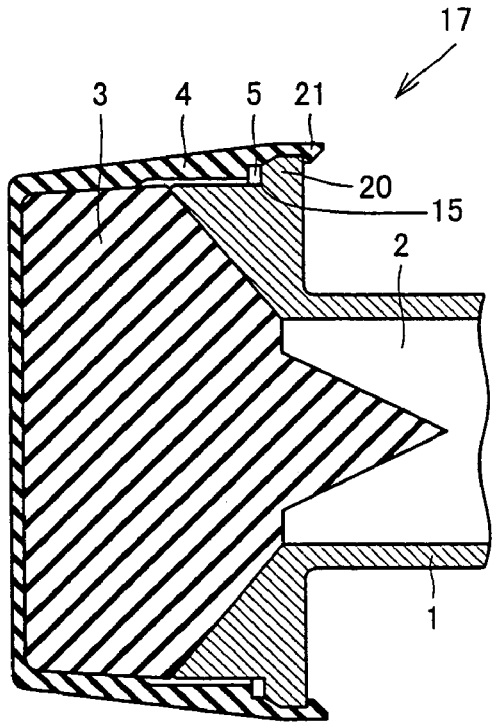
FIG. 3 is a partial enlarged schematic illustration showing a feedhorn portion of the converter shown in FIG. 2.

Referring to FIGS. 1–3, an antenna and a converter according to the present invention will be described.

As shown in FIG. 1, an antenna 10 according to the present invention includes a parabolic portion 11 for reflecting a radio wave, an arm 12 connected to parabolic portion 11, and a converter 13 arranged at the tip of arm 12 for receiving the radio wave. To converter 13, a cable 14 is connected for transmitting the received radio wave (a signal) to other devices such as a tuner. Further, to the back side of parabolic portion 11, a support arm, which is a fixing support member for fixedly arranging antenna 10 in a prescribed position, is mounted.

As shown in FIGS. 2 and 3, converter 13 is formed of chassis body 1, a circuitry portion 6 connected to chassis body 1, a dielectric 3 arranged to close an opening of a waveguide 2 formed in chassis body 1, a waterproof cover 4 covering dielectric 3 and connected to chassis body 1, and an exterior cabinet 8 as an exterior member covering chassis body 1 and circuitry portion 6. The lower portion of exterior cabinet 8 is connected to the tip of arm 12 shown in FIG. 1. Further, to circuitry portion 6, an output terminal 7 for connecting a cable 14 shown in FIG. 1 is formed. Chassis body 1 with waveguide 2, dielectric 3 and waterproof cover 4 constitute a feedhorn portion 17 shown in FIG. 3 of a converter 13 (see FIG. 2).

In the following, the structure of converter 13 will be described more specifically. To an opening (an open end) located at the front side of waveguide 2 provided to chassis body 1, dielectric 3 in a prescribed shape shown in FIG. 3 is connected. The shape of dielectric 3 is determined such that it attains a radiation pattern conforming to an angular aperture of antenna 10 (see FIG. 1). Waterproof cover 4 formed with a weatherproof material having the electric characteristics similar to dielectric 3 is arranged so as to be tightly attached to the external circumferential face of dielectric 3. It is noted that the aforementioned electric characteristics specifically mean permittivity and dielectric loss tangent.

As the material forming dielectric 3 and waterproof cover 4, for example, polypropylene can be employed. Preferably, only for the material of waterproof cover 4, the polypropylene is provided with weatherproof processing. Thus, manufacturing costs of dielectric 3 and waterproof cover 4 can be reduced. Further, as the material forming dielectric 3, polystyrene, polyethylene, or Teflon (R) can be employed in place of polypropylene. Still further, as the material forming waterproof cover 4, polystyrene or Teflon (R) can be employed in place of polypropylene. It is noted that, as a material forming dielectric 3 and waterproof cover 4, a material other than the resins listed above can be employed.

As can be seen from FIG. 3, at the rear end of waterproof cover 4 (the end on chassis body 1 side), a nail portion 21 that is a convex portion protruding toward internal circumferential side of waterproof cover 4 is formed. In chassis body 1, to a portion of a sidewall (a side face) facing to the rear end of waterproof cover 4, a flange portion 20 that is a portion protruding toward the outside is formed. By nail portion 21 of waterproof cover 4 and flange portion 20 of chassis body 1 mating with each other, waterproof cover 4 is fixed to chassis body 1. Additionally, dielectric 3 is pushed into a position on the chassis body side by waterproof cover 4, and thereby fixed in a state tightly attached to the open end of waveguide 2 of chassis body 1.

It is noted that, while nail portion 21 may be formed on the entire circumference of the rear end of waterproof cover 4, it may be formed at a plurality of locations (for example, at two locations, or at three or more locations) in the rear end. Further, while flange portion 20 of chassis body 1 may be formed on the entire circumference of the sidewall of chassis body 1, it may be formed only at locations facing to nail portions 21 of waterproof cover 4 when they are formed at a plurality of locations.

In front of flange portion 20 (i.e., as seen from flange portion 20 in a direction where dielectric 3 is provided) of chassis body 1, a groove 15 is provided to the entire circumference of the sidewall of chassis body 1. A ring packing 5 is inserted in this groove 15. As shown in FIG. 3, in a state where waterproof cover 4 is fixedly connected to chassis body 1, ring packing 5 is tightly attached to the internal circumferential face of waterproof cover 4 and the internal circumferential face of groove 15 of chassis body 1. As a result, the internal space enclosed by chassis body 1 and waterproof cover 4 (the space where dielectric 3 is arranged) can be separated from the space outside of converter 13 (see FIG. 2) by ring packing 5. Thus, excellent airtightness of the space where dielectric 3 is arranged can be maintained.

Next, an operation of converter 13 is briefly described. A radio wave reflected from parabolic portion 11 for reflecting a radio wave shown in FIG. 1 enters waveguide 2 from the front of converter 13 (i.e., as seen from chassis body 1, from the side where dielectric 3 is provided) through waterproof cover 4 and dielectric 3. The radio wave (signal) that entered waveguide 2 is transmitted to circuitry portion 6 connected to chassis body 1. In this circuitry portion 6, the transmitted signal is amplified and the frequency of the signal is converted to a prescribed intermediate frequency. The signal of which frequency has been converted is output from an output terminal 7 to an external device such as a tuner (a receiver for satellite broadcasting) via cable 14.

The effect of the antenna and the converter according to the present invention as above will be described in the following, in contrast with a converter as a comparative example. While the converter shown in FIG. 7 basically has the similar structure as the converter shown in FIGS. 1–3, it has differently structured dielectric 33 and waterproof cover 34.

Figure 7:
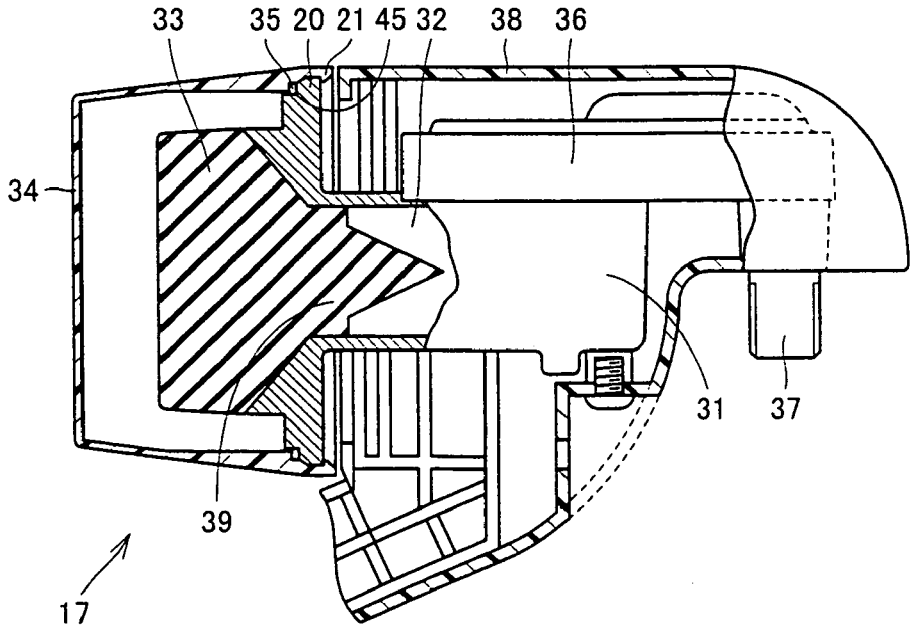
FIG. 7 is a schematic illustration showing a converter as a comparative example for showing the effect of the antenna and the converter shown in FIGS. 1–3.

Specifically, the converter shown in FIG. 7 includes a chassis body 31 to which a waveguide 32 is formed, a circuitry portion 36 connected to chassis body 31, a dielectric 33 fixed to a front-side opening of waveguide 32, a waterproof cover 34 arranged to cover dielectric 33, and an exterior cabinet 38 arranged to cover chassis body 31 and circuitry portion 36. To circuitry portion 36, an output terminal 37 is formed. Dielectric 33 has a portion (dielectric press-fit portion 39) press-fitted with an internal circumferential face of waveguide 32 and thus fixed. Here, the external circumferential face of dielectric press-fit portion 39 and the internal circumferential face of waveguide 32 may be bonded. Waterproof cover 34 made of a material different from dielectric 33 is arranged with a prescribed distance from dielectric 33. At the rear end of waterproof cover 34, a nail portion 21 is formed. In the sidewall of chassis body 31, to a portion facing to the rear end of waterproof cover 34, a flange portion 20 that is a convex shaped portion is formed. By nail portion 21 of waterproof cover 34 and flange portion 20 of chassis body 31 mating and fixed with each other, waterproof cover 34 is fixedly connected to chassis body 31.

In front of flange portion 20 of chassis body 31, a groove 45 is formed. A ring packing 35 is inserted in this groove 45. As shown in FIG. 7, in a state where waterproof cover 34 is fixedly connected to chassis body 31, ring packing 35 is tightly attached to the internal circumferential face of waterproof cover 34 and the internal circumferential face of groove 45 of chassis body 31. Thus, airtightness of the region where dielectric 33 is located can be maintained, which is the region enclosed by waterproof cover 34 and chassis body 31.

In the converter shown in FIG. 7, however, dielectric 33 and waterproof cover 34 are made with different materials. Accordingly, in order to prevent waterproof cover 34 from affecting electric characteristics (such as radiation characteristics and VSWR (Voltage Standing Wave Ratio), for example) of dielectric 33, waterproof cover 34 and dielectric 33 must be spaced apart from each other as shown in FIG. 7. As a result, the size of waterproof cover 34 has been larger than that of dielectric 33.

Additionally, as a method for fixing dielectric 33 to chassis body 31, when dielectric press-fit portion 39 that is a portion of dielectric 33 is press-fitted with the internal circumferential face of waveguide 32 of chassis body 1 and thereby fix them, the dimensional precision of the internal circumferential face of waveguide 32 and that of dielectric press-fit portion 39 of dielectric 33 must be high. Otherwise, the connecting strength of the connecting portion of dielectric 33 and waveguide 32 of chassis body 31 may be decreased. Additionally, when the ambient temperature of the converter largely changes due to the environment of the location where the antenna is installed, dielectric 33 may expand or shrink due to heat, affected by the changes in the temperature. In such a case, it may be difficult to stably maintain the strength of the connecting portion of dielectric 33 and waveguide 32. As a result, the reliability of the converter may disadvantageously be degraded.

Further, when dielectric press-fit portion 39 of dielectric 33 and the internal circumferential face of waveguide 32 are fixed with an adhesive, the adhesive may flow to the internal circumferential face of waveguide 32. In such a case, there has been a problem that the flown out adhesive may disadvantageously pose negative effect to the electric characteristics of waveguide 32.

In contrast, in the converter shown in FIGS. 1–3, waterproof cover 4 is formed with the same material as dielectric 3 (i.e., the material having the electric characteristics similar to dielectric 3). Thus, as shown in FIGS. 2 and 3, waterproof cover 4 and dielectric 3 can be arranged tightly attached to each other without a space between them. This enables to regard waterproof cover 4 and dielectric 3 as an integral dielectric. As a result, converter 13 with excellent electric characteristics can be implemented. Additionally, as waterproof cover 4 and dielectric 3 can be fixed as tightly attached to each other, waterproof cover 4 can be made smaller than waterproof cover 34 of the converter as a comparative example shown in FIG. 7. As a result, the costs of the waterproof cover can be reduced, and hence, the manufacturing costs of converter 13 can be reduced.

Further, by forming waterproof cover 4 with a weatherproof material (for example, resin provided with weatherproof processing), the reliability of antenna 10 (see FIG. 1) can be maintained for a long period when antenna 10 is used outdoors.

Still further, with the converter shown in FIGS. 1–3, dielectric 3 is fixed to the opening (open end) of waveguide 2 of chassis body 1, by waterproof cover 4 pushing dielectric 3. Thus, it is not necessary to press-fit a portion (dielectric press-fit portion 39) of dielectric 33 into waveguide 32, as required with the converter shown in FIG. 7. As a result, the dimensional precision of dielectric 3 and the internal circumferential face of waveguide 2 can be reduced as compared to the dimensional precision of dielectric 33 and the internal circumferential face of waveguide 32 in the converter as a comparative example shown in FIG. 7. As a result, the manufacturing costs of converter 13 can be reduced as compared to the manufacturing costs of the converter shown in FIG. 7.

Still further, with the converter shown in FIG. 7, as described above, the strength of the connecting portion of dielectric 33 and the internal circumferential face of waveguide 32 may change as dielectric 33 expands or shrinks due to heat, affected by the changes in the ambient temperature. On the other hand, with the converter 13 shown in FIGS. 1–3, waterproof cover 4 pushes dielectric 3, and waterproof cover 4 is fixed to chassis body 1 by nail portion 21 mating with flange portion 20. Accordingly, waterproof cover 4 can be fixed to chassis body 1 in a state where waterproof cover 4 applies stress to dielectric 3. Thus, even when dielectric 3 expands or shrinks due to heat, affected by the changes in the temperature as described above, as dielectric 3 is pushed toward the opening side of waveguide 2, the connecting strength of the connecting portion of dielectric 3 and chassis body 1 can be maintained at a prescribed strength or more. As a result, the reliability of the converter can be increased.

Still further, since it is not necessary to use an adhesive to the connecting portion of dielectric 3 and waveguide 2 of chassis body 1, the problem of the adhesive flowing into the internal circumferential face of waveguide 2, as described with reference to the converter shown in FIG. 7, can be prevented.

Second Embodiment

Figure 4:
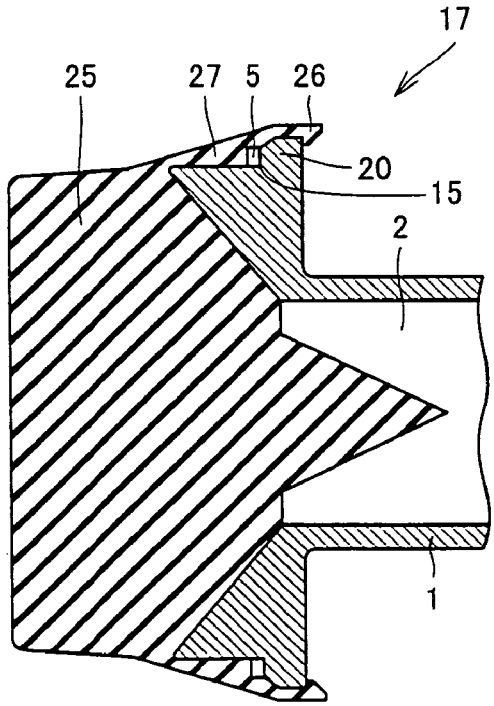
FIG. 4 is a partial enlarged schematic illustration related to a description of a second embodiment of a converter according to the present invention.

Referring to FIG. 4, a second embodiment of a converter according to the present invention is described. FIG. 4 corresponds to FIG. 3.

While the converter having feedhorn portion 17 shown in FIG. 4 basically has the similar structure as the converter shown in FIGS. 1–3, the difference can be found in that the dielectric and the waterproof cover shown in FIGS. 1–3 are formed as an integral member. Specifically, in the converter shown in FIG. 4, dielectric 25 is formed with a weatherproof material (for example, an insulating resin such as polypropylene provided with weatherproof processing). At the rear end of dielectric 25, an extending portion 27 extending on the external circumferential face of chassis body 1 is formed. At an end of extending portion 27, a nail portion 26 that is a convex portion protruding to chassis body 1 side is formed. In a portion of the sidewall of chassis body 1 facing to the end of extending portion 27, a flange portion 20 that is a convex portion is formed. By nail portion 26 of dielectric 25 and flange portion 20 of chassis body 1 mating with each other, dielectric 25 is fixedly connected to chassis body 1.

It is noted that the converter having feedhorn portion 17 shown in FIG. 4 is to be arranged on antenna 10 (see FIG. 10), similarly to converter 13 shown in FIGS. 1–3. While nail portion 26 of dielectric 25 may be formed on the entire circumference of extending portion 27, it may be formed at a plurality of locations in the circumferential direction, similarly to converter 13 shown in FIGS. 1–3. Further, while flange portion 20 of chassis body 1 may be formed on the entire external circumference of chassis body 1, it may be formed only at a plurality of locations in the circumferential direction of the external circumference of chassis body 1.

In chassis body 1, a groove 15 is formed in front of flange portion 20. A ring packing 5 is inserted in this groove 15. When dielectric 25 is fixedly connected to chassis body 1, ring packing 5 is tightly attached to the internal circumferential face of extending portion 27 of dielectric 25 and the internal circumferential face of groove 15. Thus, the airtightness of the connecting portion of dielectric 25 and waveguide 2 of chassis body 1 is maintained.

The converter shown in FIG. 4 achieves the effect, in addition to the effect achieved by converter 13 shown in FIGS. 1–3, that the number of components of the converter can be reduced as it does not require a waterproof cover that is formed separately from dielectric 25. As a result, the manufacturing costs such as costs of components of the converter or costs of assembly can further be reduced.

EXAMPLE 1

The inventors of the present invention made samples of the converters corresponding to the first and second embodiments, and of the converter as a comparative example shown in FIG. 7, and measured the radiation pattern characteristics and the return loss characteristics thereof, in order to check the effect of the converters according to the present invention. It is noted that these samples are similar in basic sizes, such as the size of the chassis body and/or the diameter of the dielectric, but their waterproof covers 4 and 34 are different in size and/or material.

Figure 5:
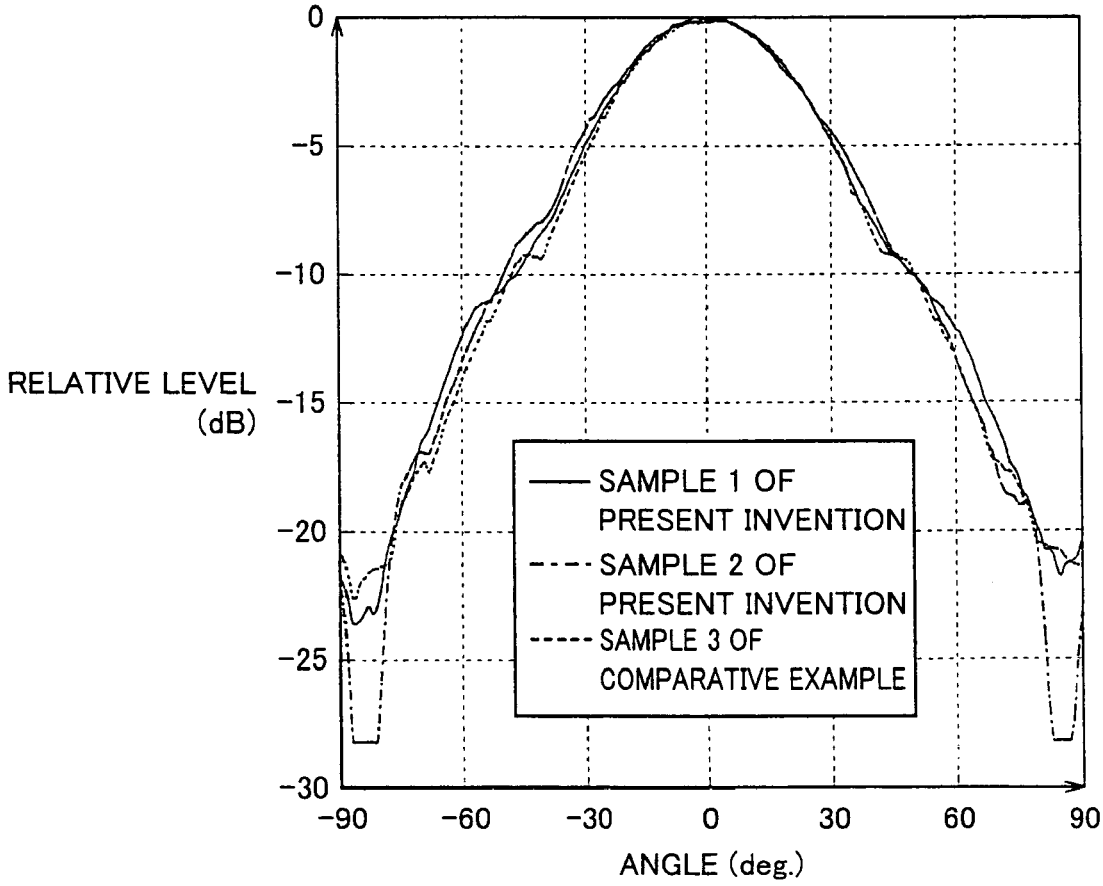
FIG. 5 is a graph showing radiation pattern characteristics of each sample.
Figure 6:
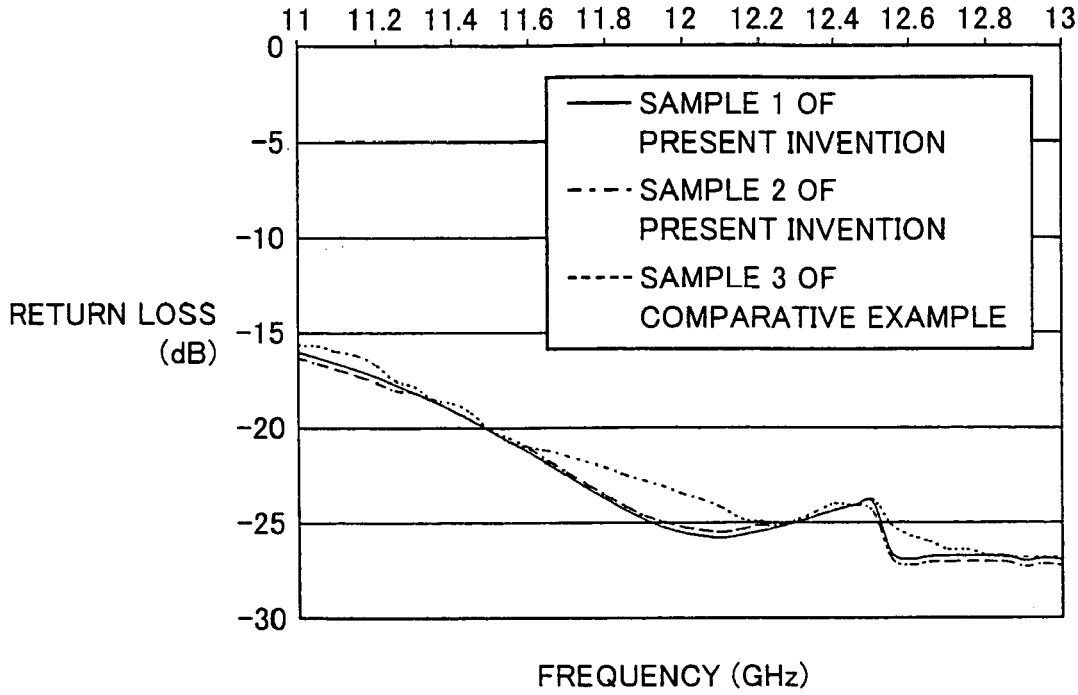
FIG. 6 is a graph showing return loss characteristics of each sample.

It is noted that, in the samples (samples 1 and 2) corresponding to the first and second embodiments, polypropylene was employed as the material of the dielectric and the waterproof cover. As for the sample (sample 3) of the comparative example, polypropylene was employed as the material of dielectric 33 and as well as the material of waterproof cover 34. The result is shown in FIGS. 5 and 6.

The abscissa indicates angle (unit: deg.), while the ordinate indicates relative level (unit: dB). In FIG. 6, the abscissa indicates frequency (unit: GHz), while the ordinate indicates return loss (unit: dB). As can be seen from FIGS. 5 and 6, respective feedhorn portions of sample 3 of the comparative example shown in FIG. 7 (the structure where provision of a space between dielectric 33 and waterproof cover 34 serves to eliminate the negative effect of waterproof cover 34 to the electric characteristics of feedhorn portion 17) and samples 1 and 2 with the structures shown in the first and second embodiments of the present invention exhibit substantially the same characteristics.

Summarizing the characteristic structure of feedhorn portion 17 (see FIG. 3) as one example of a feedhorn according to the present invention as described above, feedhorn portion 17 according to the present invention constitutes part of converter 13, and includes chassis body 1 with waveguide 2 having an opening, dielectric 3 as a dielectric member connected to the opening, and waterproof cover 4 as a protective member. Waterproof cover 4 covers dielectric 3 and contacts (tightly attached) to a portion of the surface of dielectric 3 (in dielectric 3, a portion of the surface away from waveguide 2). Waterproof cover 4 is formed of a material having substantially the same electric characteristics (permittivity and dielectric loss tangent) as the material forming dielectric 3. Waterproof cover 4 has the shape conforming to the surface of dielectric 3, and formed so as to be in contact with the entire surface, away from waveguide 2, of dielectric 3. It should be noted that waterproof cover 4 may be in contact with only a part of the surface, away from waveguide 2, of dielectric 3.

In such a case, as waterproof cover 4 and dielectric 3 can be regarded as an integral dielectric, dielectric 3 can be protected by waterproof cover 4, and simultaneously, feedhorn portion 17 exhibiting an excellent electric characteristics can be implemented. Additionally, as dielectric 3 and waterproof cover 4 can be brought into contact (tightly attached) with each other, provision of the space between dielectric 3 and waterproof cover 4 is not necessary. Accordingly, dielectric 3 and waterproof cover 4 can be made similar in their size. In other words, waterproof cover 4 can be reduced in size than conventional technique. Accordingly, feedhorn portion 17, and hence converter 13 including feedhorn 17 can be reduced in size.

In feedhorn portion 17, the material forming waterproof cover 4 may be a weatherproof material. Here, the weatherproof material means a material that can withstand to a certain degree changes in the environment such as sunlight, wind, rain, and temperature variations, and resin such as polypropylene, polystyrene or Teflon® provided with weatherproof processing is applicable. Other materials may be included in the weatherproof material, as long as they withstand changes in the environment as described above.

In such a case, when converter 13 including feedhorn portion 17 is used outdoors, soundness of waterproof cover 4 can be maintained for a longer period. Accordingly, the possibility of intrusion of foreign objects such as water into inside of converter 13 invited by degradation of waterproof cover 4 can be reduced. As a result, the reliability of feedhorn portion 17 and converter 13 can be improved.

In feedhorn portion 17, waterproof cover 4 may include an end extending on the surface (side face) of chassis body 1 and to which nail portion 21 is formed. In chassis body 1, on the surface (side face) facing to the end of waterproof cover 4, flange portion 20 as a protruding portion mating with nail portion 21 may be formed. Waterproof cover 4 is fixed to chassis body 1 by nail portion 21 and flange portion 20 mating with each other, and it may push dielectric 3 toward chassis body 1 side. Nail portion 21 and flange portion 20 may be in any shape as long as nail portion 21 can mate with flange portion 20. While the protruding portion mating with nail portion 21 may be formed by protruding the side face of chassis body 1 as shown in FIG. 3, by removing a portion of the side face of chassis body 1, the resulting stepped portion at the end on dielectric 3 side may be used as the protruding portion.

In such a case, with a relatively simple structure where nail portion 21 and flange portion 20 mate with each other, waterproof cover 4 can be fixed to chassis body 1. By waterproof cover 4 pushing dielectric 3, it is ensured that dielectric 3 is fixedly connected to the opening of waveguide 2 of chassis body 1. Accordingly, the possibility of the occurrence of defectiveness such as disconnection of the connecting portion of dielectric 3 and the opening of waveguide 2 can be reduced. As a result, feedhorn portion 17 and converter 13 with high reliability can be obtained.

Feedhorn portion 17 further includes a sealed portion provided with ring packing 5 as an airtightness retaining portion for retaining airtightness of the connecting portion of chassis body 1 and waterproof cover 4.

In such a case, the possibility of intrusion of foreign objects such as water into inside (where dielectric 3 is located, or inside waveguide 2 to which dielectric 3 is connected) of feedhorn portion 17 can be reduced. Accordingly, the possibility of the occurrence of the problem that the electric characteristics of feedhorn portion 17 is impaired by the intrusion of water or the like can be reduced.

In feedhorn portion 17, the aforementioned airtightness retaining portion includes ring packing 5 as a packing arranged in groove 15 formed on the surface (side face) in chassis body 1 facing to the end of waterproof cover 4. Groove 15 is formed over the entire side face of chassis body 1. Ring packing 5 contacts to the inner wall of groove 15 and contacts to a portion of the surface (internal circumferential face) of the end of waterproof cover 4, the portion facing to groove 15.

In such a case, with a simple structure using ring packing 5, the airtightness retaining portion (sealing portion) retaining airtightness of the connecting portion of waterproof cover 4 and chassis body 1 can be implemented. Accordingly, increase in manufacturing costs of converter 13 including feedhorn portion 17 can be suppressed, which is associated with formation of the airtightness retaining portion.

As shown in FIG. 4, feedhorn portion 17 according to the present invention includes chassis body 1 including waveguide 2 having an opening, and dielectric 25 connected to the opening and the surface thereof partially exposed to the outside of feedhorn portion 17 (i.e., converter 13). Dielectric 25 includes an end extending on the surface (side face) of chassis body 1 and to which nail portion 26 is formed. In chassis body 1, to the surface (side face) facing to the end of dielectric 25, flange portion 20 as a protruding portion mating with nail portion 26 is formed. Dielectric 25 is fixed to chassis body 1 in a state being pushed toward chassis body 1 side, by nail portion 26 mating with flange portion 20.

In such a case, with a relatively simple structure where nail portion 26 and flange portion 20 mating with each other, dielectric 25 can surely be fixed to chassis body 1. Accordingly, the possibility of the occurrence of defectiveness such as disconnection of the connecting portion of dielectric 25 and the opening of waveguide 2 can be reduced. As a result, the converter including feedhorn portion 17 having high reliability can be obtained.

Additionally, as the surface of dielectric 25 partially exposed to the outside of feedhorn portion 17, i.e., a waterproof cover as a protective member for protecting dielectric 25 is not provided, feedhorn portion 17 can be reduced in size.

In feedhorn portion 17, the material forming dielectric 25 is a weatherproof material. In such a case, when the converter including feedhorn portion 17 is used outdoors, soundness of dielectric 25 can be maintained for a longer period. Accordingly, the possibility of intrusion of water or the like into inside of feedhorn portion 17 invited by degradation of dielectric 25 can be reduced. As a result, the reliability of feedhorn portion 17 can be improved.

Feedhorn portion 17 further includes an airtightness retaining portion (sealing portion by ring packing 5) for retaining airtightness of the connecting portion of chassis body 1 and dielectric 25.

In such a case, the possibility of intrusion of water or the like into inside (for example, inside waveguide 2 to which dielectric 25 is connected) of feedhorn portion 17 can be reduced. Accordingly, the possibility of the occurrence of the problem that the electric characteristics of feedhorn portion 17 is impaired by the intrusion of water or the like can be reduced.

In feedhorn portion 17, the airtightness retaining portion includes ring packing 5 as a packing arranged in groove 15 formed on the surface (side face) in chassis body 1 facing to the end of dielectric 25. Groove 15 is formed over the entire side face of chassis body 1. Ring packing 5 contacts to the inner wall of groove 15 and contacts to a portion of the surface of the end of dielectric 25, the portion facing to groove 15.

In such a case, with a simple structure using ring packing 5, the airtightness retaining portion retaining airtightness of the connecting portion of dielectric 25 and chassis body 1 can be implemented. Accordingly, increase in manufacturing costs of feedhorn portion 17 (and hence, of the converter) can be suppressed, which is associated with formation of the airtightness retaining portion.

Converter 13 as a radio wave receiving converter according to the present invention includes feedhorn portion 17 shown in FIG. 3 or FIG. 4. Antennal 10 according to the present invention includes converter 13.

Thus, converter 13 and antenna 10 of small size and with high reliability can be implemented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A feedhorn, comprising:

a chassis body including a waveguide having an opening; and a dielectric member connected to said opening, and having a surface partially exposed to outside of said feedhorn; wherein said dielectric member includes an end extending on a surface of said chassis body and to which a nail portion is formed, in said chassis body, on a surface facing to said end of said dielectric member, a protruding portion mating with said nail portion is formed, and said dielectric member is fixed to said chassis body by said nail portion mating with said protruding portion.

2. The feedhorn according to claim 1, wherein said material forming said dielectric member is a weatherproof material.

3. The feedhorn according to claim 1, further comprising an airtightness retaining portion for retaining airtightness of a connecting portion of said chassis body and said dielectric member.

4. The feedhorn according to claim 3, wherein said airtightness retaining portion includes a packing arranged in a groove formed on said surface in said chassis body facing to said end of said dielectric member, said packing contacting to an inner wall of said groove and contacting to a portion of a surface of said end of said dielectric member, said portion facing to said groove.

5. A radio wave receiving converter comprising the feedhorn according to claim 1.

6. An antenna comprising the radio wave receiving converter according to claim 5.

* * * * *